US007140573B1

(12) United States Patent
Jerstroem et al.

(10) Patent No.: US 7,140,573 B1
(45) Date of Patent: Nov. 28, 2006

(54) ROTATING ARTICLE DISPENSER

(75) Inventors: Goeran Jerstroem, New York, NY (US); Boris Kontrovich, Brooklyn, NY (US); Alec Drummond, Brooklyn, NY (US); Sally Bernadine Rumble, New York, NY (US); Arsenio Garcia Monsalve, New York, NY (US)

(73) Assignee: Helen of Troy Limited, St. Michael (BB)

( * ) Notice: Subject to any disclaimer, the term of this patent is extended or adjusted under 35 U.S.C. 154(b) by 0 days.

(21) Appl. No.: 10/340,116

(22) Filed: Jan. 10, 2003

(51) Int. Cl.
*B65H 16/04* (2006.01)

(52) U.S. Cl. ..... 242/597.3; 242/597.4; 242/597.6; 242/597.7

(58) Field of Classification Search ..... 242/597.4, 242/597.6, 597.7, 597.3
See application file for complete search history.

(56) References Cited

U.S. PATENT DOCUMENTS

| | | | | |
|---|---|---|---|---|
| 2,562,923 | A | 8/1951 | Kolivoski | |
| 3,843,071 | A | 10/1974 | Graham | |
| 3,937,414 | A * | 2/1976 | Bank et al. | 242/557 |
| 4,012,007 | A | 3/1977 | Cunningham | |
| 4,030,676 | A | 6/1977 | Bardsley | |
| 4,273,299 | A | 6/1981 | Ness | |
| 4,436,224 | A | 3/1984 | McInerny | |
| 4,487,376 | A | 12/1984 | Compton | |
| 4,535,948 | A | 8/1985 | Gillen | |
| 4,690,345 | A | 9/1987 | Cotey | |
| 4,714,211 | A | 12/1987 | Hwang | |
| 4,720,053 | A | 1/1988 | Vance | |
| 4,726,179 | A | 2/1988 | Smith et al. | |
| 4,738,385 | A | 4/1988 | Bell | |
| 4,792,102 | A | 12/1988 | Olson | |
| 4,848,690 | A | 7/1989 | Lemoine | |
| 4,898,335 | A | 2/1990 | Eysink | |
| 5,125,586 | A * | 6/1992 | Whitethorn | 242/597.6 |
| 5,125,609 | A | 6/1992 | Demeo | |
| 5,135,179 | A | 8/1992 | Morano | |
| 5,170,956 | A | 12/1992 | McTaggart | |
| 5,297,750 | A | 3/1994 | Hunt | |
| 5,477,709 | A * | 12/1995 | Rowe | 68/212 |
| 5,605,304 | A | 2/1997 | Ahern, Jr. | |
| 5,718,108 | A * | 2/1998 | Oppl et al. | 57/132 |
| 5,763,984 | A | 6/1998 | Day | |
| 5,842,655 | A * | 12/1998 | McCarthy | 242/129 |
| 5,938,141 | A | 8/1999 | Kanbar | |
| 6,138,874 | A | 10/2000 | Audrey | |
| 6,161,796 | A | 12/2000 | Daniels | |
| 6,216,920 | B1 | 4/2001 | Baggett | |
| 6,467,717 | B1 | 10/2002 | Pedicano | |
| 2002/0130211 | A1 * | 9/2002 | Kerr | 242/422.5 |

* cited by examiner

*Primary Examiner*—John Q. Nguyen
(74) *Attorney, Agent, or Firm*—Seyfarth Shaw LLP

(57) ABSTRACT

A rotating article dispenser is provided for receiving and dispensing articles, such as a paper towel roll. The dispenser includes a handle which may be easily attached and removed by use of a clamping head provided in the handle which clamps around a bulb protruding from a first end of a tube. Upon depression of a button attached to the clamping head, the head may be released from the bulb so that the handle may be removed from the first end of the dispenser tube.

51 Claims, 4 Drawing Sheets

ROTATING ARTICLE DISPENSER

The present invention pertains to a rotating article dispenser and in particular a dispenser that may receive an article thereon and allow for rotation of the article, for example, a paper towel roll.

BACKGROUND

Paper towel holders are known that provide for a base and a rod to allow for rotation of the paper towel roll thereon. Such dispensers are known that have a handle at the top of the rod which may be removable. Such dispensers have attachment means for the handle, for example, so that the handle may be screwed and unscrewed to or from the rod. Such attachment means may be time consuming and difficult to operate; as the handle must be turned many rotations in order to remove it or attach it to the rod. As well, such handles do not provide for gripping surfaces that allow for the gripping of the entire dispenser assembly in order to remove individual paper towel segments from the paper towel roll.

SUMMARY

The present invention pertains to a rotating article dispenser comprising a base, a tube rotatably mounted to the base, the tube including a bulb at the first end, and a handle attached to the tube. The handle includes a clamping head for clamping to the bulb, the clamping head is adjacent to a button so that upon activation of the button the clamping head will unclamp from the bulb and release the handle from the tube. In an embodiment, the button may be reciprocatingly mounted within a guide sleeve. In an embodiment, the guide sleeve may include a terminal end and a proximal end and an inner wall therebetween. The terminal end forms petals for clamping around the bulb.

The button includes a spreader head that may reciprocate upon attachment of the handle to the tube so that the spreader head may slide through the guide sleeve so that when the spreader head is adjacent the terminal end, the spreader head abuts the bulb and is expanded and when the spreader head is separated from the bulb and adjacent the proximal end the clamping head is contracted in order to clamp onto the bulb. In an embodiment, the spreader head may move between an expanded position when abutting the bulb and a closed position adjacent the proximal end. In an embodiment, the clamping head may include a plurality of petals forming an interior cavity having a generally cylindrical shape for clampingly receiving the bulb therein. In an embodiment, the bulb includes a neck and the terminal ends of the petals engage the neck of the bulb in order to clampingly engage the bulb. In an embodiment, the base may include a lower base member and an upper base member forming a cavity therebetween. In an embodiment, a bearing member may be mounted in the cavity. In an embodiment, the bearing member may be mounted to an axle protruding from the base.

In an embodiment, a weight may be mounted in the cavity. In an embodiment, the weight may be cylindrically shaped and mounted at a peripheral edge of the base. In an embodiment, the dispenser may comprise a foot mounted to the lower base member. In an embodiment, the foot may be a cylindrical shoulder formed of a resilient material and attached at a peripheral edge of the lower base member. In an embodiment, the upper base member may include an axial bore for receiving an axle protruding from the lower base member. In an embodiment, the axial bore may be formed of a cylindrical wall having an exterior wall. In an embodiment, the exterior wall may include a wing protruding therefrom. In an embodiment, the exterior wall may include three wings. In an embodiment, the axial wall may include a bearing neck for receiving the tube thereon. In an embodiment, the tube may be an elongated, hollow cylinder and the bearing neck is cylindrical and the tube is rotatably mounted to the bearing neck. In an embodiment, the bearing neck may include a shoulder abutting an edge of the tube.

In an embodiment, the bulb is generally ellipsoid in shape and is mounted at a linear axis of the tube. In an embodiment, the dispenser may comprise a rotating head mounted at the first end of the tube having wings protruding therefrom. In an embodiment, the rotating head may include a ridge for abutting an edge of the first end of the tube. In an embodiment, the dispenser may comprise a handle mounted to the rotating head. In an embodiment, the handle may include an external sleeve that is received by the rotating head. In an embodiment, the handle may include an upper knob attached to the clamping head and the upper knob is mounted to a lower knob attached to the external sleeve. In an embodiment, the upper knob and lower knob form a generally toroidal shape. In an embodiment, the upper knob is generally mushroom shaped having an upper grip and an axial tube protruding therefrom. In an embodiment, the axial tube may be received in a bore of the lower knob so that the axial tube is adjacent the external sleeve. In an embodiment, the guide sleeve may be attached to the end of the axial tube. In an embodiment, the axial tube may include a tube bore for receiving the clamping head therein. In an embodiment, the clamping head may include a cylindrical body and include a button surface at an end and a body of the clamping head may be received by the tube bore so that the button surface is mounted in the tube bore and generally coplanar to the upper grip.

A method of unclamping a handle from an article dispenser is provided comprising the steps of providing a handle having a resilient clamping head clamped to a bulb protruding from a tube of an article dispenser, depressing a button attached to the clamping head, moving the clamping head through a guide sleeve, expanding the clamping head and unlatching the clamping head from the bulb, and removing the handle from the bulb and tube assembly of the dispenser.

In an embodiment, the method further comprises the step of providing fingers on the clamping head which are received within a tapering portion of the guide sleeve and when the clamping head is adjacent the terminal end of the guide sleeve expanding the clamping head fingers to release the bulb.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION

Figure 2:
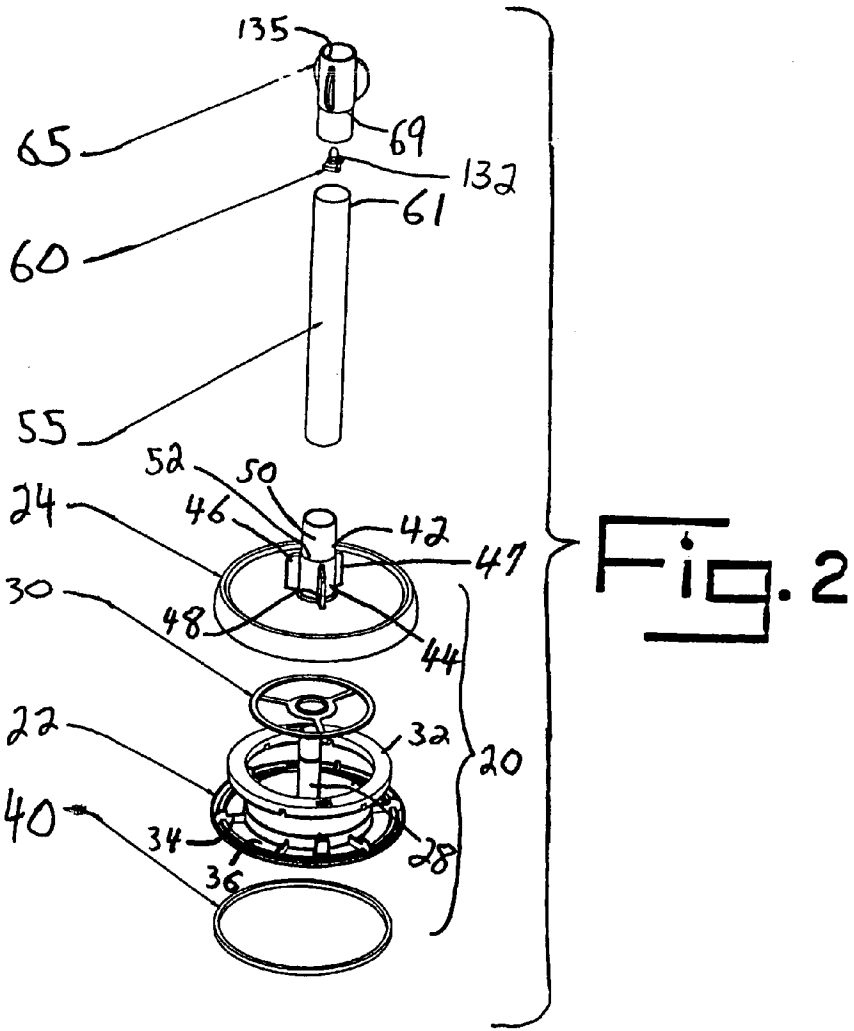
FIG. 2 is an exploded view of the dispenser of FIG. 1 with the handle removed.
Figure 1:
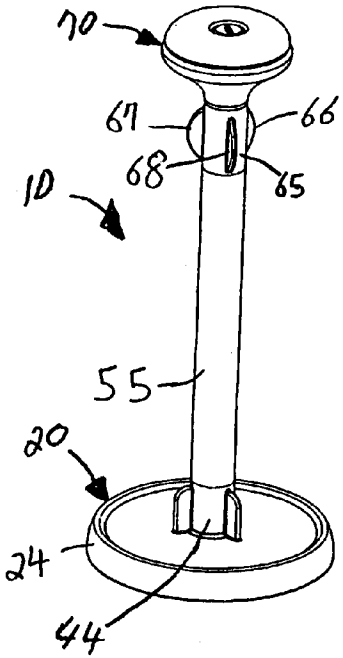
FIG. 1 is a perspective view of the dispenser of the present invention.
Figure 3:
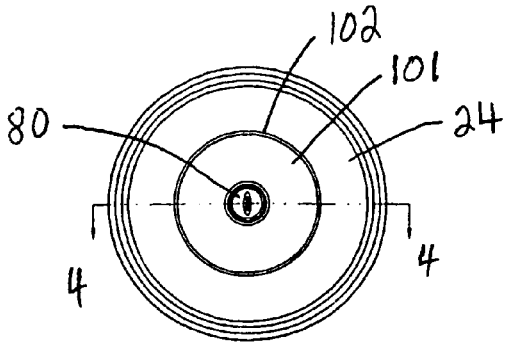
FIG. 3 is a top plan view of the dispenser of FIG. 1.

An embodiment of the invention will be described with respect to FIGS. 1–7. A dispenser 10 is illustrated in FIG. 1 and includes a base 20 which is comprised of a lower base member 22 and upper base member 24 (see FIGS. 2 and 4). The upper base member 24 is mounted to the lower base member 22 forming a cavity 26 there between. Protruding from the lower base member 22 is an axle 28. In an embodiment, the axle is a cylindrical tube. Mounted to the axle 28 is a bearing member 30 upon which the upper base member 24 is mounted. In an embodiment, the bearing member 30 allows for rotation of the upper base member 24 upon the lower base member 22. Mounted within the cavity 26 is a weight 32. In a preferred embodiment, the weight forms a shoulder which is mounted upon weight supports 34 formed at the peripheral edge of the base 36. In a preferred embodiment, the lower base member 22 is molded of a polymer material and the weight supports 34 are integrally molded with the lower base member 22. Mounted to the lower base member 22 is a foot 40. In an embodiment, the foot is a cylindrical shoulder mounted at the bottom of the lower base member 22 along a peripheral edge. In an embodiment, the foot is formed of a resilient rubber-like material and provides for a frictional mounting of the dispenser 10 to a surface, such as a countertop.

The upper base member 24 includes an axial bore 42 formed through a cylindrical hub portion having an exterior wall 44. The axial bore 42 receives the axle 28 therein in order to mount the upper base member 24 to the lower base member 22. The exterior wall 44 includes wings 46, 47, 48. The wings protrude from the exterior wall 44 and support a paper towel roll when placed on the dispenser 10. The exterior wall 44 includes a bearing neck 50 and a shoulder 52. The neck 50 is telescopically received in the lower end of a hollow tube 55 which seats upon the shoulder 52.

Figure 4:
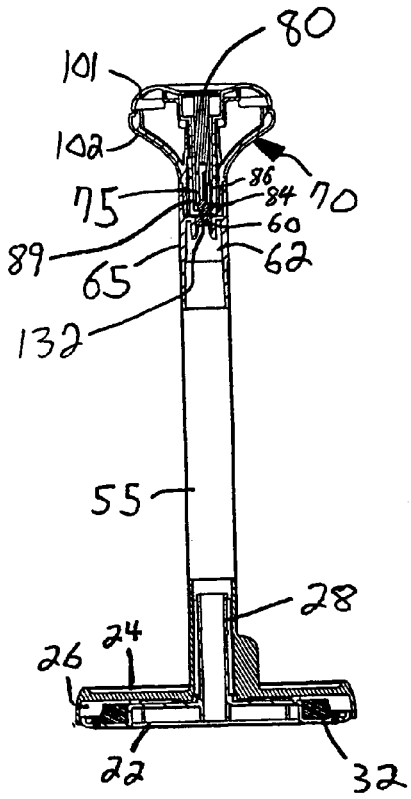
FIG. 4 is a sectional view of the dispenser of FIG. 3 taken at line 4—4.
Figure 5:
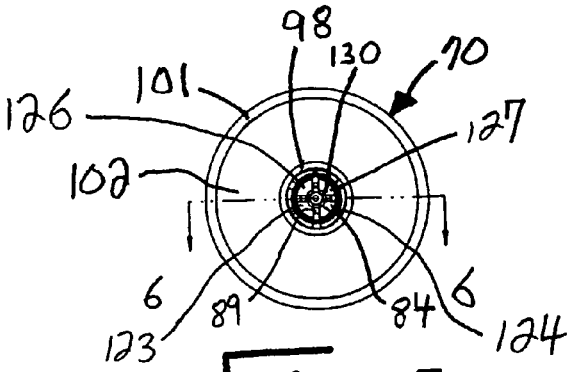
FIG. 5 is an enlarged bottom plan view of the handle of the invention of FIG. 1.

The tube 55, in an embodiment, is cylindrical and includes a bulb 60 mounted at a first end 61 (see FIG. 4). More specifically, in an embodiment, the tube 55 may be metal and includes a cap 62 at the first end 61, which cap includes the bulb 60 thereon. In an embodiment, the bulb 60 may be attached to the cap 62 via press-fit. In an embodiment, the cap 62 is formed within a rotating head 65. The rotating head 65 includes wings 66, 67 and 68 for engaging an article, for example, a paper towel roll (not shown). The rotating head 65 also includes an annular shoulder around the circumference of the rotating head 65 which abuts the first end 61 of the tube 55 and provides for a bearing surface upon which the rotating head 65 may rotate (see FIG. 2).

Figure 6:
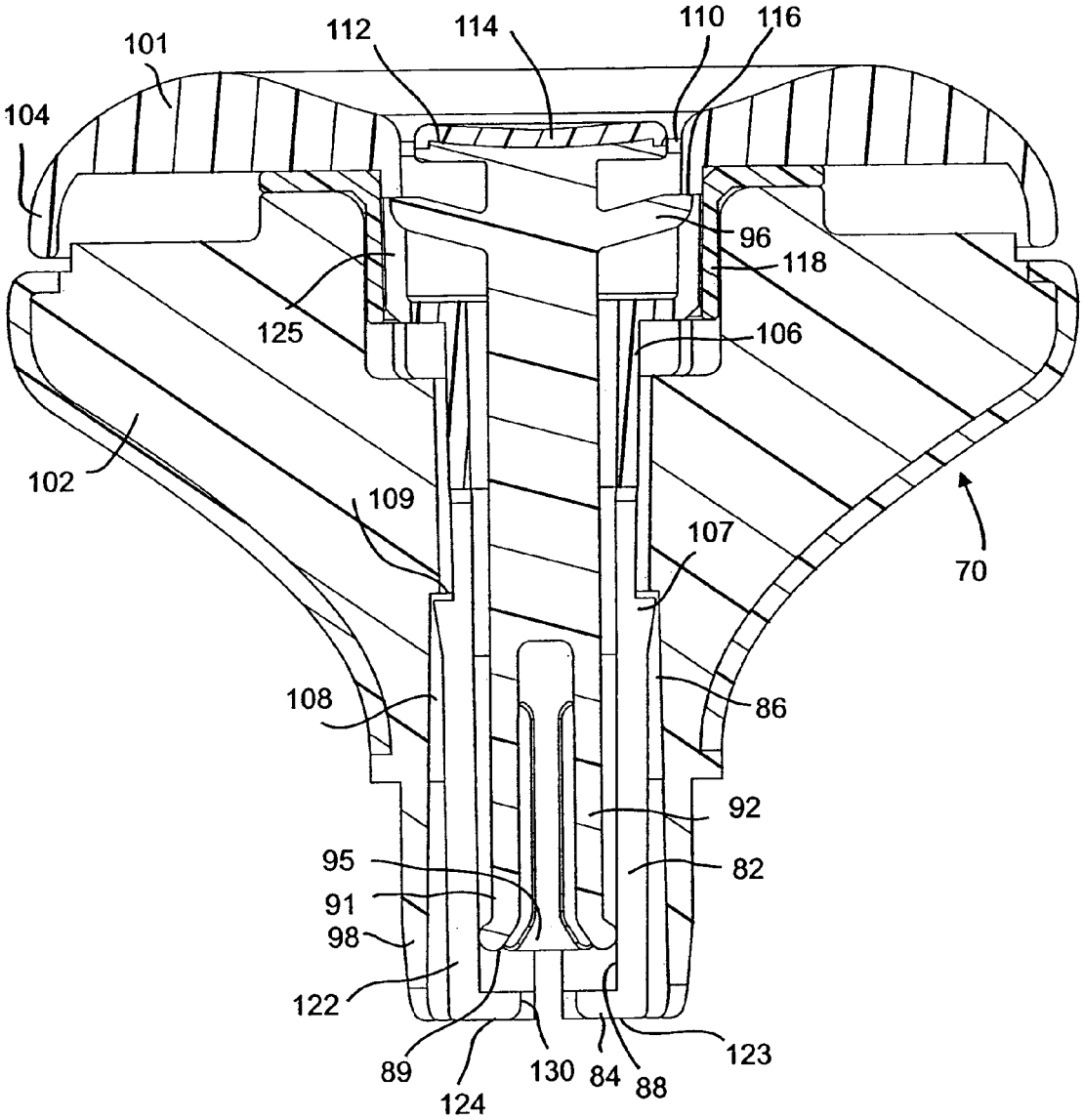
FIG. 6 is an enlarged sectional view of the handle of FIG. 5 taken at line 6—6.
Figure 7:
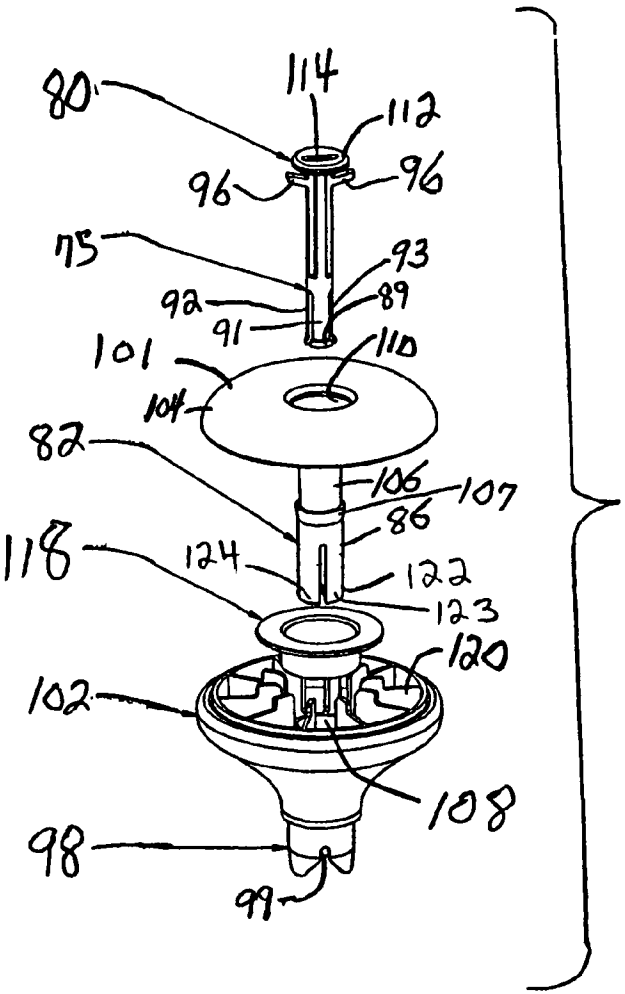
FIG. 7 is an exploded perspective view of the handle of FIG. 5.

A handle 70 is mounted to the rotating head 65. The handle 70 includes a spreader head 75. Attached to the spreader head 75 is a button 80. In an embodiment, the spreader head 75 and button 80 may be integrally molded of a polymer material. The handle 70 includes a guide sleeve 82 (see FIGS. 6 and 7). The guide sleeve 82 includes a terminal end 84 and a proximal end 86. The guide sleeve 82 forms an inner wall 88 which in a preferred embodiment is linear. In an alternate embodiment the inner wall 88 may be tapered so that it's inner diameter at the terminal end 84 is less than the inner diameter at the proximal end 86. The spreader head 75 reciprocates within the guide sleeve 82 and moves between an expanded or spread position where the first end 89 is abutting the bulb and adjacent the terminal end 84 and a closed position where the first end 89 is adjacent the proximal end 86 of the guide sleeve 82 (see FIG. 4). The spreader head 75 includes a plurality of resilient fingers 91, 92, 93 forming a generally cylindrical end. Gaps are formed between the fingers 91, 92, 93 and the fingers form a generally cylindrical cavity 95. The cavity 95 is formed to frictionally engage the ellipsoid head of the bulb 60. The resilient spreader head 75 includes a stop abutment member 96 for stopping the reciprocating movement of the spreader head 75 in its uppermost clamping position (as shown in FIG. 6).

The handle 70 also includes an external sleeve 98 for mounting within the rotating head 65. In an embodiment, the external sleeve 98 is formed of three segments having semicircular notches 99 formed therebetween for receiving protrusions 135 formed on the inner wall of the rotating head 65 (one shown in FIG. 2). The mounting of the notches 99 to the protrusions 135 prevent rotation of the handle 70 relative to the rotating head 65. This provides for only the rotating head 65 to rotate on the tube 55.

The handle 70 is formed of an upper knob 101 and a lower knob 102. The upper knob 101 is generally mushroom shaped and includes an upper grip 104. Protruding from the upper knob 01 is an axial tube 106. Attached at an end of the axial tube is the guide sleeve 82. In an embodiment, an annular neck 107 is formed between the guide sleeve 82 and the upper portion of the axial tube 106. The axial tube 106 is received by a bore 108 of the lower knob 102. When the axial tube 106 is inserted within the bore 108, the annular neck 107 is compressed as it slides through the bore until it passes an annular shoulder 109; whereupon the annular neck 107 will expand and will abut against the annular shoulder 109 in order to retain the axial tube 106 and upper knob 101 on the lower knob 102. The upper knob 101 includes a tube bore 110 which receives the spreader head 75 therein. The spreader head 75 includes a cylindrical body 112 and a button surface 114 at an end opposite the first end 89. In an embodiment, the cylindrical body 112, button surface 114 and spreader head 75 are formed integrally of polymer material. The tube bore 110 is formed in the upper knob 101 and forms an annular bore edge 116 (see FIG. 6) that the stop abutment member 96 of the spreader head 75 abuts in order to stop the spreader head 75 from sliding up and out of the bore 110.

A central bearing 118 is mounted within the lower knob 102, between the bore 108 and the upper knob 101. The central bearing member 118 allows for the upper knob 101 to rotate within the bore 108 so that the upper grip 104 may rotate upon the upper portion of the lower knob 102. In an embodiment, the lower knob 102 is formed of a polymer material and axial struts 120 are integrally molded therewith which help to align the central bearing member 118 therein.

Therefore, it may be understood that the handle 70 is assembled by inserting the central bearing member 118 to the lower knob 102 so that it is axially aligned to the bore 108. The upper knob 101 is then mounted to the lower knob 102 by inserting the axial tube 106 through the center of the central bearing 118 and into the bore 108 of the lower knob 102. Upon complete insertion of the upper knob 101 within the bore 108 the annular neck 107 snaps into position against the annular shoulder 109 in order to retain the upper knob 101 to the lower knob 102. The spreader head 75 is then mounted within tube bore 110 of the upper knob 101. In an embodiment, the stop abutment member 96 is flexible and resilient so that it may abut against the inner wall of the bore 110 upon insertion. After being completely inserted, the abutment member 96 will expand and extend beyond the diameter of the bore 110 and abut against the edge 116 in order to restrict the spreader head 75 from being removed from the tube bore 110.

The assembly of the upper knob 101 to the lower knob 102 and the central bearing 118 therebetween forms a reciprocating area 125 (see FIG. 6) within which the abutment member 96 of the spreader head 75 may reciprocate. The abutment member 96 may move axially in the reciprocating area 125 allowing the first end 89 of the spreader head 75 to move between the spread position, where the first end 89 abuts the bulb 60 and is adjacent the terminal end 84 of the guide sleeve 82; and the closed position where the first end 89 is adjacent the proximal end 86 of the guide sleeve 82. In an embodiment, the guide sleeve 82 is formed so that its terminal end 84 forms a clamping head 122 having four petals 123, 124, 126, 127 having an opening 130. In an embodiment, the opening 130 has a diameter less than the diameter of the bulb 60 so that the petals must expand to clamp onto the bulb 60. The bulb 60 includes a neck 132 and in the clamping position the terminal ends of the petals engage the neck 132 of the bulb 60 (see FIG. 4). In an alternate embodiment the opening has a diameter slightly greater than the diameter of the bulb 60, so that the bulb 60 may be received therethrough.

After assembly of the handle 70, it is then assembled to the tube 54. The rotating head 65 is attached to the tube 55 at the first end 61 and surrounds the bulb 60. The external sleeve 98 is inserted within the upper end of the rotating head 65 so that the semicircular notches 99 respectively receive the protrusions 135. Simultaneously, upon insertion of the external sleeve 98, the opening 130 of the clamping head 122 abuts the bulb 60 which forces the petals to expand and receive the bulb 60 therethrough. The bulb 60 abuts against the terminal ends 84 of the clamping head 122 at the opening 130. As the handle 70 is continued to be pushed into the bore of the rotating head 65, the bulb 60 is received into the opening 130 of the clamping head 122 and the petals 123, 124, 126, 127 surround the bulb 60 as the clamping head 122 is received within the rotating head 65. As pressure is continued to be exerted against the handle 70, the clamping head 122 encompasses the bulb 60, which causes the terminal ends 84 to clamp around the neck 132 of the bulb 60 in order to attach the handle to the tube 55.

In order to release the handle 70 from the first end 61 of the tube 55 (so that an article, such as a paper towel roll may be placed onto the tube) the following steps occur. The button surface 114 is depressed so that the spreader head 75 is moved from its position with the first end 89 adjacent the proximal end 86 so that it slides along the inner wall 88 toward the terminal end 84 of the guide sleeve 82. When the fingers 91, 92, 93 of the spreader head 75 abut the bulb 60, the fingers 91, 92, 93 resile and expand. The plurality of fingers 91, 92, 93 expand so that the outer diameter of the spreader head 75 is equal to or greater than the inner diameter of the guide sleeve and the expanded spreader head 75 abuts against the resilient petals 123, 124, 126, 127 of the clamping head 122 to spread and open the petals. Therefore, the bulb 60 may be slidingly released from the terminal ends 84 of the clamping head 122 and, as the handle 70 is pulled upward and away from the tube 55, the external sleeve 90 is allowed to be removed from the bore of the rotating head 65 and the bulb 60 is removed from within the guide sleeve 82 and through the opening 130 of the clamping head 122. Thus, the handle 70 is completely removed from the dispenser tube 55 and rotating head 65.

After an article, such as a paper towel roll, is mounted onto the tube 55; the process may be reversed and the handle 70 may be replaced on the rotating head 65 so that it is clampingly attached thereto. It may be understood that the wings 66, 67, 68 of the rotating head 65 abut the interior cylindrical surface of an article, such as a paper towel roll, so that it is grasped and frictionally retained thereon. Upon removal of paper sheets from the paper towel roll, the entire tube 55 and rotating head 65 rotate. Generally, the base 20 remains stationary upon rotation of a paper towel roll on the dispenser 10.

While particular embodiments have been shown and described, it will be apparent to those skilled in the art that changes and modifications may be made without departing from the principles of the rotating article dispenser in its broader aspects. The matter is set forth in the foregoing description and accompanying drawings is offered by way of illustration only and not as a limitation.

What is claimed is:

1. A rotating article dispenser comprising:

a base;

a tube mounted to the base, the tube including a first end having a bore and a bulb disposed within the bore at the first end and the bulb having a terminal end; and a handle including a button and a resilient clamping head received within the bore for clamping around the terminal end of the bulb in order to attach the handle to the tube and upon activation of the button the clamping head will unclamp from the bulb and release the handle from the tube.

2. The dispenser of claim 1 wherein the clamping head includes a guide sleeve and the button is reciprocatingly mounted within the guide sleeve.

3. The dispenser of claim 2 wherein the guide sleeve forms resilient petals and includes a terminal end and a proximal end and the terminal end for clamping around the bulb.

4. The dispenser of claim 3 wherein the button includes a spreader head that reciprocates within the guide sleeve and the spreader head slides through the guide sleeve and abuts the bulb, the spreader head is expanded by insertion of the bulb therein and the expanded spreader head abuts against the clamping head in order to expand the clamping head to be released from the bulb.

5. The dispenser of claim 4 wherein when the spreader head is separated from the bulb and adjacent the proximal end, the clamping head is contracted in order to clamp onto the bulb.

6. The dispenser of claim 1 wherein the clamping head includes a plurality of petals forming an interior cavity having a generally cylindrical shape for clampingly receiving the bulb therein.

7. The dispenser of claim 6 wherein the bulb includes a neck and the terminal ends of the petals engage the neck of the bulb in order to clampingly engage the bulb.

8. The dispenser of claim 1 wherein the base includes a lower base member and an upper base member forming a cavity therebetween.

9. The dispenser of claim 8 wherein a bearing member is mounted in the cavity.

10. The dispenser of claim 9 wherein the bearing member is mounted to an axle protruding from the base.

11. The dispenser of claim 8 wherein a weight is mounted in the cavity.

12. The dispenser of claim 11 wherein the weight is cylindrically shaped and is mounted at a peripheral edge of the base.

13. The dispenser of claim 8 further comprising a foot mounted to the lower base member.

14. The dispenser of claim 13 wherein the foot is a cylindrical shoulder formed of a resilient material and attached at a peripheral edge of the lower base member.

15. The dispenser of claim 8 wherein the upper base member includes an axial bore for receiving an axle protruding from the lower base member.

16. The dispenser of claim 15 wherein the axial bore is formed in a cylindrical member having an exterior wall.

17. The dispenser of claim 16 wherein the exterior wall includes a wing protruding therefrom.

18. The dispenser of claim 17 wherein the exterior wall includes three wings.

19. The dispenser of claim 16 wherein the cylindrical member includes a bearing neck for receiving the tube thereon.

20. The dispenser of claim 19 wherein the tube is an elongated, hollow cylinder and the bearing neck is cylindrical and the tube is rotatably mounted to the bearing neck.

21. The dispenser of claim 19 wherein the bearing neck includes a shoulder abutting an edge of the tube.

22. The dispenser of claim 1 wherein the bulb is generally ellipsoid in shape and is mounted at a longitudinal axis of the tube.

23. The dispenser of claim 1 further comprising a head mounted at the first end of the tube and the head having wings protruding therefrom.

24. The dispenser of claim 23 wherein the head includes a ridge for abutting an edge of the first end of the tube.

25. The dispenser of claim 24 further comprising the handle mounted to the head.

26. The dispenser of claim 25 wherein the handle includes an external sleeve that is received by the head.

27. The dispenser of claim 26 wherein the handle includes an upper knob attached to the clamping head and the upper knob is mounted to a lower knob attached to the external sleeve.

28. The dispenser of claim 27 wherein the upper knob and lower knob form a generally toroidal shape.

29. The dispenser of claim 28 wherein the upper knob is generally mushroom shaped having an upper grip and an axial tube protruding therefrom.

30. The dispenser of claim 29 wherein the axial tube is received in a bore of the lower knob so that the axial tube is adjacent the external sleeve.

31. The dispenser of claim 30 wherein a guide sleeve is attached to an end of the axial tube.

32. The dispenser of claim 31 wherein the axial tube includes a tube bore for receiving a spreader head therein.

33. The dispenser of claim 32 wherein the spreader head includes a cylindrical body and includes a button surface at an end and the body of the spreader head is received by the tube bore so that the button surface is mounted in the tube bore and generally coplanar to the upper grip.

34. A method of unclamping a handle from an article dispenser is provided comprising the steps of:

providing a handle having a resilient clamping head clamped to a bulb protruding from a tube of an article dispenser;

depressing a button attached to the handle;

moving a spreader head through a guide sleeve;

expanding the spreader head to spread and unlatch the clamping head from the bulb; and removing the handle from the bulb and tube of the dispenser.

35. The method of claim 34 further comprising the step of providing fingers on the spreader head and the fingers abutting the bulb, expanding the bulb, expanding the clamping head and releasing the clamping head from the bulb.

36. A rotating article dispenser comprising:

a base;

a tube rotatably mounted to the base, the tube including a first end having a bulb and a head, the head having wings protruding therefrom and a ridge for abutting an edge of the first end of the tube; and a handle including a lower knob having an external sleeve surrounding a button and a resilient clamping head for clamping to the bulb in order to attach the handle to the tube and upon activation of the button the external sleeve and the clamping head will unclamp from the bulb and release the handle from the tube.

37. A rotating article dispenser comprising:

a base;

a tube having a first end and an opposite second end, the first end forming a bore and an engagement member disposed within the bore, and the second end mounted to the base;

a handle having a grip shaped to receive a users hand, a sleeve extending from the handle, the sleeve having an actuator and the actuator for extending into the bore and engaging the engagement member in order to provide for retention and removal of the handle from the tube; and the engagement member includes a lip and the actuator includes a latch structure for engaging the lip so that upon insertion of the sleeve within the bore the latch structure abuts the lip and is snap-fit against the lip in order to retain the handle on the tube.

38. The dispenser of claim 37 wherein the handle includes a button connected to the actuator and upon depression of the button, the actuator causes the latch structure to disengage from the engagement member so that the handle may be removed from the tube.

39. The dispenser of claim 38 wherein the latch structure includes a resilient petal for clamping on the engagement member.

40. The dispenser of claim 38 wherein the latch structure includes a clamping head for clamping on the engagement member.

41. The dispenser of claim 38 wherein the latch structure includes a resilient finger for clamping on the engagement member.

42. The dispenser of claim 37 wherein multiple latch structures form a clamping head that attaches to the engagement member and the sleeve includes a guide sleeve.

43. The dispenser of claim 37 wherein the upper grip is mounted on a lower grip.

44. The dispenser of claim 37 wherein the engagement member includes a bulb protruding within the bore.

45. The dispenser of claim 37 wherein the lip is formed by a bulb protruding within the bore.

46. The dispenser of claim 37 wherein the handle includes a button disposed adjacent to the grip, the button having a body extending through the handle and the sleeve and attached to the actuator so that depression of the button causes the actuator to move between a first and second position.

47. The dispenser of claim 46 wherein the sleeve includes an opening and the actuator is exposed in the opening.

48. The dispenser of claim 46 wherein the handle includes an upper grip and the button is centered in the upper grip.

49. A rotating article dispenser comprising:

a base;

a tube having a first end and an opposite second end, the first end forming a bore and an engagement member disposed within the bore, and the second end mounted to the base;

a handle having a grip shaped to receive a users hand, a sleeve extending from the handle, the sleeve having an actuator and the actuator for extending into the bore and engaging the engagement member in order to provide for retention and removal of the handle from the tube, and the engagement member includes a lip and the actuator includes a latch structure for engaging the lip so that upon insertion of the sleeve within the bore the latch structure abuts the lip and is snap-fit against the lip in order to retain the handle on the tube and the handle includes a button connected to the actuator and upon depression of the button, the actuator causes the latch structure to disengage from the engagement member so that the handle may be removed from the tube.

50. The dispenser of claim 49 wherein the latch structure includes a resilient petal and the engagement member includes a bulb and the resilient petal clamps on the bulb.

51. A rotating article dispenser comprising:

a base;

a tube having a first end and an opposite second end, the first end forming a bore and an engagement member disposed within the bore, and the second end mounted to the base;

a handle having a grip shaped to receive a users hand, a sleeve extending from the handle, the sleeve having an actuator and the actuator for extending into the bore and engaging the engagement member in order to provide for retention and removal of the handle from the tube, and the engagement member includes a lip and the actuator includes a latch structure for engaging the lip so that upon insertion of the sleeve within the bore the latch structure abuts the lip and is snap-fit against the lip in order to retain the handle on the tube and the handle includes a button disposed adjacent to the grip, the button having a body extending through the handle and the sleeve and attached to the actuator so that depression of the button causes the actuator to move between a first and second position.

* * * * *